US012173600B2

(12) United States Patent
Fripp et al.

(10) Patent No.: US 12,173,600 B2
(45) Date of Patent: Dec. 24, 2024

(54) DOWNHOLE VALVE POSITION SENSING SYSTEMS, DOWNHOLE VALVES, AND METHODS TO DETERMINE A POSITION OF A DOWNHOLE VALVE

(71) Applicant: Halliburton Energy Services, Inc., Houston, TX (US)

(72) Inventors: Michael Linley Fripp, Singapore (SG); Luke William Holderman, Singapore (SG); David Allen Dockweiler, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/742,143

(22) Filed: May 11, 2022

(65) Prior Publication Data

US 2023/0366311 A1 Nov. 16, 2023

(51) Int. Cl.
*E21B 47/092* (2012.01)
*E21B 34/06* (2006.01)

(52) U.S. Cl.
CPC ..... *E21B 47/092* (2020.05); *E21B 34/06* (2013.01)

(58) Field of Classification Search
CPC ..... E21B 47/092; E21B 34/06; E21B 47/09; E21B 21/10
See application file for complete search history.

(56) References Cited

U.S. PATENT DOCUMENTS 6,808,160 B2 10/2004 Hayakawa et al.
8,393,386 B2 3/2013 Lake et al.
9,322,233 B2 4/2016 Wilson
9,671,211 B2 6/2017 Gao et al.
9,822,611 B2 11/2017 Delzell et al.
10,443,344 B2 10/2019 Vasques et al.
11,111,779 B2 9/2021 Inglis et al.
2004/0163809 A1 8/2004 Mayeu et al.
2006/0157240 A1 7/2006 Shaw et al.
2009/0128141 A1* 5/2009 Hopmann ..... E21B 47/092 324/207.24
2009/0151790 A1 6/2009 Ranjan et al.
(Continued)

FOREIGN PATENT DOCUMENTS

CN 107002490 A 8/2017
WO 2018191407 A1 10/2018
WO 2020086065 A1 4/2020

OTHER PUBLICATIONS

International Search Report & Written Opinion in PCT/US2022/029450, mailed Feb. 9, 2023.
(Continued)

*Primary Examiner* — Caroline N Butcher
(74) *Attorney, Agent, or Firm* — Barnes & Thornburg, LLP

(57) ABSTRACT

A downhole valve position sensing system includes a magnetic material that is shiftable by an actuation member of a downhole valve to a plurality of positions along a downhole valve from a first position of the plurality of positions along the downhole valve. The downhole valve position sensing system also includes a sensor assembly that is mechanically coupled to the downhole valve and comprising a magnetic sensor that is configured to detect a magnetic signal generated by the magnetic material at a set of positions of the plurality of positions along the downhole valve.

20 Claims, 7 Drawing Sheets

(56) References Cited

U.S. PATENT DOCUMENTS

| | | | | |
|---|---|---|---|---|
| 2014/0243750 | A1* | 8/2014 | Larsen | A61M 5/24 604/218 |
| 2017/0247960 | A1 | 8/2017 | Kyle et al. | |
| 2021/0115759 | A1* | 4/2021 | Ng | E21B 34/12 |
| 2021/0332669 | A1 | 10/2021 | Joseph et al. | |

OTHER PUBLICATIONS

Munih et al., "A Novel Design Concept of Electromagnetic Valve Actuator with High Starting Force", Energies, 2019, 12, 3300, pp. 1-15.

* cited by examiner

DOWNHOLE VALVE POSITION SENSING SYSTEMS, DOWNHOLE VALVES, AND METHODS TO DETERMINE A POSITION OF A DOWNHOLE VALVE

BACKGROUND

The present disclosure relates generally to downhole valve position sensing systems, downhole valves, and methods to determine a position of a downhole valve.

Wellbores are sometimes drilled into subterranean formations to allow for the extraction of hydrocarbons and other materials. Valves are sometimes disposed in a wellbore and are utilized during one or more well operations to restrict fluid flow through the wellbore.

BRIEF DESCRIPTION OF THE DRAWINGS

Illustrative embodiments of the present disclosure are described in detail below with reference to the attached drawing figures, which are incorporated by reference herein, and wherein.

Figure 1:
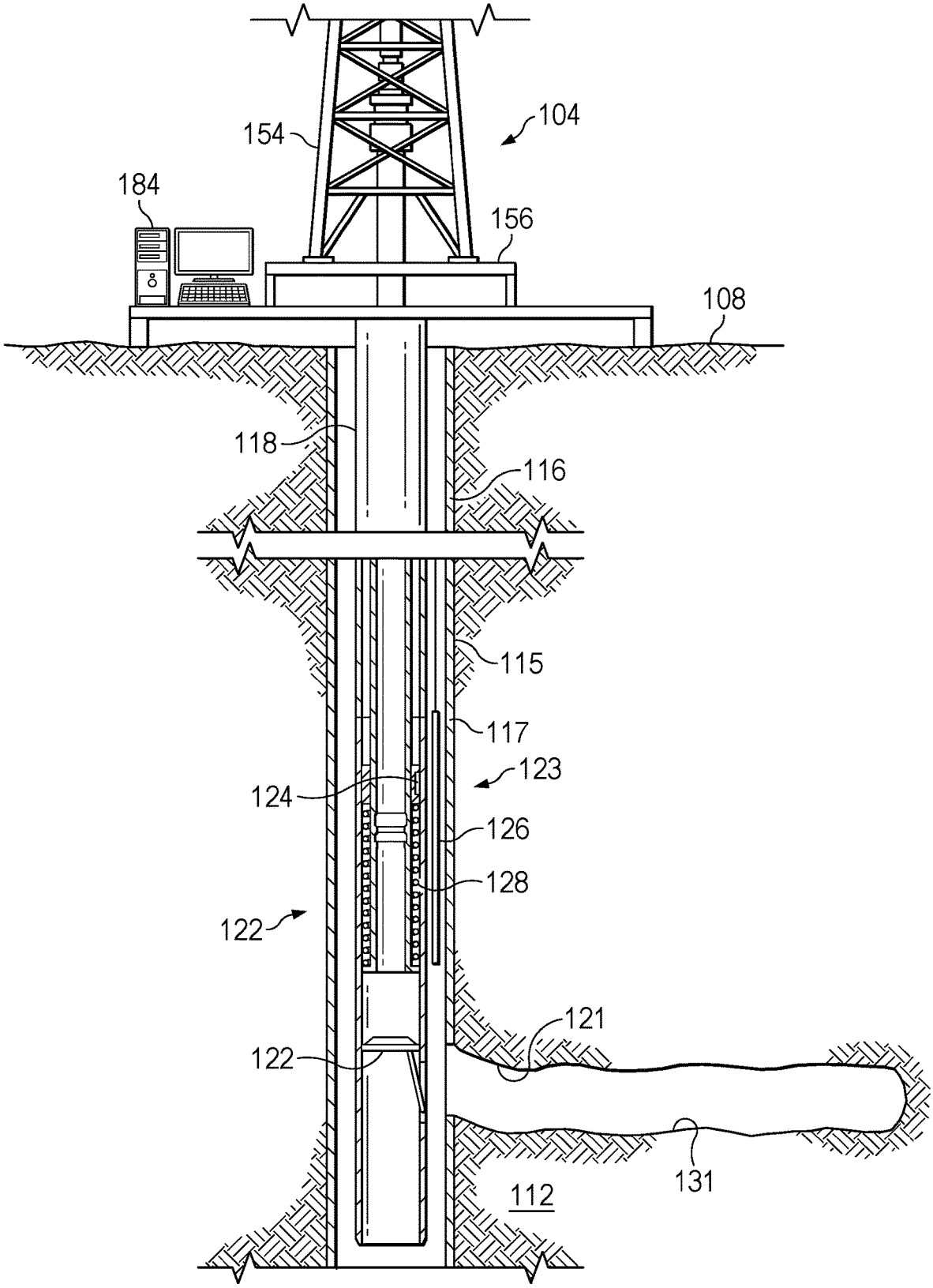
FIG. 1 shows an example of a well environment in which a downhole valve having a downhole valve position sensing system is deployed.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to downhole valve position sensing systems, downhole valves, and methods to determine a position of a downhole valve. A downhole valve position sensing system utilized to determine a position of a downhole valve (such as whether the downhole valve is open, partially open, or closed) has a magnetic material that is shiftable by an actuation member of the downhole valve. As referred to herein, a magnetic material includes any material that is capable of being magnetized or possesses a relative magnetic permeability greater than 10. Examples of magnetic materials include magnets and similar materials or objects that produce magnetic fields, and ferromagnetic materials, such as iron, steel, nickel, cobalt, and other types of ferromagnetic materials. As referred to herein, an actuation member includes any component or device that is configured to shift along one or more positions. Examples of actuation members include, but are not limited to pistons, sleeves, covers, arms, rods, latches, springs, and other components or devices that are configured to shift at least from a first position along the downhole valve to a second position along the downhole valve. In some embodiments, the actuation member is configured to actuate the downhole valve from an open position to a closed position, and from the closed position back to the open position. As referred to herein, the position of a downhole valve refers to not only whether the downhole valve is open or closed, but also the increment by which the downhole valve is open or closed. Examples of valve positions include, but are not limited to, completely open, completely closed, 25% open, 50% open, 75% open, remains closed unless one or more actuation members of the downhole valve are shifted by one or more variable distances in one or more directions (e.g., axial direction, radial direction, circumferential direction), where each variable distance is determined by the downhole valve position sensing system, remains open unless one or more actuation members of the downhole valve are shifted by a variable distance in one or more directions, and other quantifiable metrics used to measure the increment by which the downhole valve is open or closed. Additional descriptions of different positions of the downhole valve are provided in the paragraphs below and are illustrated in at least FIGS. 2-5.

The downhole valve position sensing system also includes a sensor assembly having an array of one or more magnetic sensors, each configured to detect magnetic signals (e.g., magnetic fields, magnetic fluxes, magnetic flux density, and other types of magnetic signals) and/or changes to magnetic signals that are generated by the magnetic material as the magnetic material is shifted by the actuation member. As the magnetic material is shifted by the actuation assembly, magnetic signals generated by the magnetic material and/or changes to the magnetic signals generated by the magnetic material are detected by one or more magnetic sensors of the array of magnetic sensors. In some embodiments, a processor of the downhole valve position sensing system determines values associated with the detected magnetic signals and utilizes the values to determine the corresponding location of the magnetic material. Further, the processor utilizes the location of the magnetic material with respect to the actuation member to determine the position of the actuation member, and, in turn, utilizes the position of the actuation member to determine the position of the downhole valve. In some embodiments, the magnetic sensors are configured to detect changes or distortions to magnetic signals caused by movement of the magnetic material, or by movement of another magnetic material such as a ferromagnetic material. In one or more of such embodiments, where the magnetic sensors detect changes or distortions to the magnetic signals, the processor determines values indicative of the changes or distortions to the magnetic signals and utilizes the values to determine the corresponding location of the magnetic material. Similarly, the processor utilizes the location of the magnetic material with respect to the actuation member to determine the position of the actuation member, and, in turn, utilizes the position of the actuation member to determine the position of the downhole valve.

In some embodiments, the magnetic sensors are uniformly distributed along the sensor assembly. In other embodiments, the magnetic sensors are ununiformly distributed, with more sensors positioned at locations that correspond to the opening or the closing of the downhole valve. In some embodiments, different magnetic sensors of the array of magnetic sensors are configured and fine-tuned to detect signals of the magnetic material as the magnetic material shifts in different directions, such as in axial directions, radial directions, circumferential directions, or other directions. For example, the sensor array includes a first set of magnetic sensors configured to detect magnetic signals generated by the magnetic material as the magnetic material shifts in an axial direction, a second set of magnetic sensors configured to detect magnetic signals generated by the magnetic material as the magnetic material shifts in a radial direction, and a third set of magnetic sensors configured to detect magnetic signals generated by the magnetic material as the magnetic material shifts in a circumferential direction. In some embodiments, the magnetic sensors are non-contacting sensors, such that there is no moveable linkage between the valve and the magnetic sensors. More particularly, the only linkage between the magnetic sensors and the valve is a wireless magnetic field. In some embodiments, a pressure barrier separates the magnetic sensors and the valve. Additional descriptions of different configurations of the magnetic sensors are provided in the paragraphs below and are illustrated in at least FIGS. 2-5.

In some embodiments, the downhole valve position sensing system has multiple magnetic materials, each configured to shift to and from multiple positions along the downhole valve. In one or more of such embodiments, the downhole valve position sensing system has a first magnetic material that is shiftable along a first set of positions along the downhole valve, and a second downhole magnetic material that is shiftable along a second set of positions along the downhole valve. The one or more magnetic sensors are configured to detect the magnetic signals and/or the change to the magnetic signals due to the shifting of the first magnetic material and the second magnetic material, and data indicative of the magnetic signals are separately or collectively analyzed to determine the precise position of the downhole valve. In one or more of such embodiments, the first magnetic material is configured to shift along a first direction (e.g., along an axial direction, a radial direction, a circumferential direction, or along another direction) and the second magnetic material is configured to shift along a second direction that is different from the first direction. For example, where the downhole valve is a J-slot valve or a different type of valve that requires two directions of motion to open or close the downhole valve, the downhole valve position sensing system is configured to detect magnetic signals and/or the change to the magnetic signals due to shifting of the first magnetic material and the second magnetic material in two or more directions of motion, and to precisely determine the actual position of the downhole valve. In one or more of such embodiments, the downhole valve position sensing system is also configured to analyze the current position of the downhole valve, determine how to shift one or more actuation members to open the downhole valve, close the downhole valve, or shift the downhole valve to a desired position, and provide a recommendation on how to shift the downhole valve to a desired position.

In some embodiments the downhole valve position sensing system is a component of a downhole valve, and is operable to dynamically determine the position of the downhole valve, and to provide the position of the downhole valve to surface-based electronic devices. Additional descriptions of the downhole valve position sensing system, downhole valves, and methods to determine a position of a downhole valve are provided in the paragraphs below and are illustrated in FIGS. 1-6.

Referring now to the drawings, FIG. 1 shows an example of a well environment in which a downhole valve 122 having a downhole valve position sensing system 123 is deployed. In the illustrative embodiment, the operating environment includes a rig 104 positioned on the earth's surface 108 and extending over and around a wellbore 116. In some embodiments, rig 104 is a workover or drilling rig. Wellbore 116 extends into a subterranean formation 112 that has been formed for the purpose of recovering hydrocarbons. Wellbore 116 extends away from surface 108 over a vertical portion 115, deviates from a vertical over a deviated portion 121, and transitions to a path that approximately parallels surface 108 over a horizontal portion 131. In the embodiment of FIG. 1, vertical portion 115 is partially cased by a casing 117, which in some embodiments, also extends through horizontal portion 131. In alternative operating environments, all or portions of a wellbore are vertical, deviated at any suitable angle, horizontal, and/or curved. Wellbore 116 may be a new wellbore, an existing wellbore, a straight wellbore, an extended reach wellbore, a side-tracked wellbore, a multi-lateral wellbore, and other types of wellbores for drilling and completing one or more production zones. Further, wellbore 116 is used for both producing wells and injection wells.

A conveyance, shown as tubular 118, includes downhole valve position sensing system 123 and is lowered into the subterranean formation 112 for a variety of workover or treatment procedures throughout the life of the well. In the embodiment of FIG. 1, tubular 118 is illustrated as a production tubing string having downhole valve 122. As referred to herein, a conveyance includes any type of tubing string that is deployable into a wellbore. For example, the tubing string includes (without limitation) drill pipe, casing, rod strings, and coiled tubing. As illustrated, rig 104 includes a derrick 154 with a rig floor 156 through which tubular 118 extends into wellbore 116. In some embodiments, rig 104 has a motor-driven winch and other associated equipment for extending tubular 118 into wellbore 116 to a selected depth. While the operating environment depicted in FIG. 1 refers to a stationary rig 104 for conveying tubular 118 having downhole valve position sensing system 123 within a land-based wellbore 116, in alternative embodiments, mobile workover rigs, wellbore servicing units (such as coiled tubing units), and the like are used to lower tubular 118 having downhole valve position sensing system 123 into wellbore 116. In some embodiments, a wellbore tubular 118 having downhole valve position sensing system 123 is used in other operational environments, such as within an offshore wellbore operational environment.

Downhole valve 122 has a downhole valve position sensing system 123, a flapper 130 configured to open and close to control fluid flow of downhole valve 122, and an actuation member (piston) 128 configured to directly or indirectly engage flapper 130 to open flapper, close flapper 130, or shift flapper to a desired position. Downhole valve position sensing system 123 has a magnetic material 124 that is engaged to or coupled to actuation member 128, and a sensor assembly 126 that is mechanically coupled to downhole valve 122. As actuation member 128 shifts to engage flapper 130, one or more magnetic sensors (shown in FIG. 2) of sensor assembly 126 wirelessly detect magnetic signals (such as the magnetic field, the magnetic flux, or the magnetic flux density) and/or changes to the magnetic signals of magnetic material 124, which is shifted by actuation member 128.

A processor (not shown) of downhole valve position sensing system 123 obtains values associated with the detected magnetic signals or changes to the magnetic signals, and utilizes the obtained values to determine the corresponding location of magnetic material 124. Further, the processor utilizes the location of magnetic material 124 with respect to actuation member 128 to determine the position of actuation member 128, and, in turn, utilizes the position of actuation member 128 to determine the position of flapper 130. For example, the processor, in response to a determination that the value of the magnetic signal of magnetic material 124 at a first position, determines that actuation member 128 is in a second position, and flapper 130 is in a third position (e.g., completely open, completely closed, 25% open, remains closed unless actuation member 128 is shifted by another threshold amount, or another position). Similarly, the processor utilizes values associated with the detected change in magnetic signals (such as a change to the magnetic field, a change to the magnetic flux, or a change to the magnetic flux density) to determine the corresponding location of magnetic material 124. Further, the processor utilizes the location of magnetic material 124, the position of actuation member 128, and the position of flapper 130. In some embodiments, the processor located in a housing that houses sensor assembly 126. In some embodiments, the processor is a component of a service-based electronic device, such as controller 184. In some embodiments, the processor is a cloud-based processor, and configured to operations described herein to determine the position of actuation member 128.

Although FIG. 1 illustrates downhole valve 122 as a flapper, in some embodiments, downhole valve position sensing system 123 is a component of another type of downhole valve, including, but not limited to, a subsurface safety valve, a tubing retrievable subsurface safety valve, a fluid floss valve, a ball valve, an inflow control valve, a J-slot valve, a L-slot valve, or another type of valve configured to shift in one or more directions to control fluid flow. Further, although actuation member 128 is described as a piston, in some embodiments, actuation member 128 is a sleeve, a cover, an arm, a rod, a latch, a spring, or another component that is shiftable in one or more directions to actuate downhole valve 122. Further, although FIG. 1 illustrates magnetic sensor 124 and sensory assembly 126 being positioned along the same side of valve 122, in some embodiments, magnetic sensor 124 and sensor assembly 126 are positioned along different sides of valve 122. Additional descriptions of similar downhole valve position sensing systems and components of such downhole valve position sensing systems are provided in the paragraphs below and are illustrated in at least FIGS. 2-5.

Figure 2:
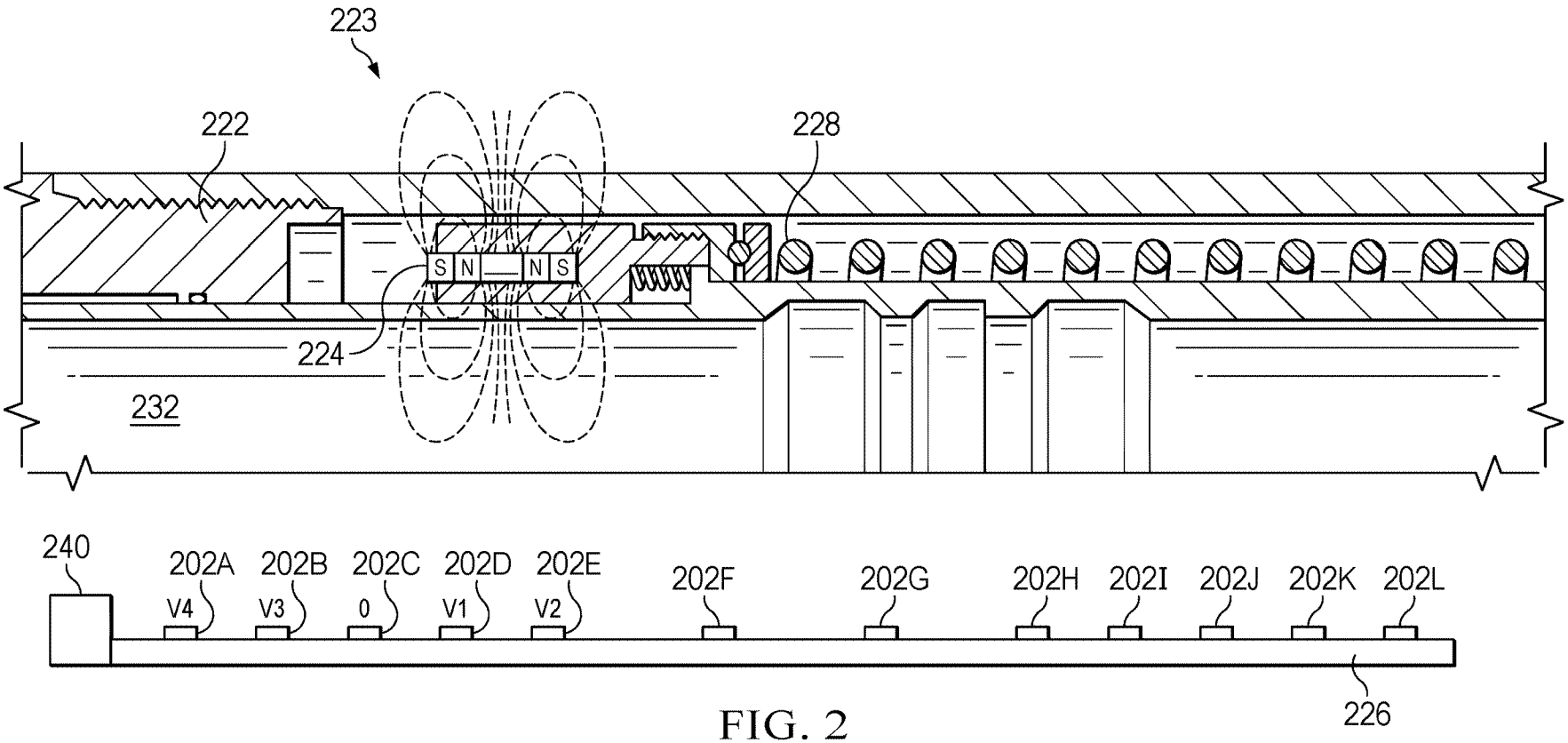
FIG. 2 is a schematic, cross-sectional view of a downhole valve position sensing system similar to the downhole valve position sensing system of FIG. 1, and deployable in the environment illustrated in FIG. 1.

FIG. 2 is a schematic, cross-sectional view of a downhole valve position sensing system 223 similar to downhole valve position sensing system 123 of FIG. 1, and deployable in the environment illustrated in FIG. 1. Downhole valve position sensing system 223 includes a magnetic material 224 that emits a magnetic field, a processor 240, and a sensor assembly 226 that is coupled to or positioned near an exterior surface of a downhole valve 222, and configured to detect the magnetic field and changes to the magnetic field of magnetic material 224. In the embodiment of FIG. 2, magnetic material 224 is indirectly coupled to an actuation member (spring) 228. More particularly, the shifting of actuation member 228 also shifts magnetic material 224 from the position illustrated in FIG. 2 to another position (not shown). Moreover, in the embodiment of FIG. 2, magnetic material 224 is positioned in a chamber that is outside of a flowbore 232 of downhole valve 222. In some embodiments, magnetic material 224 is positioned outside of downhole valve 222 or along an exterior surface of downhole valve 222. The poles of magnetic material 224 are arranged axially in FIG. 2. In some embodiments, the poles of magnetic material 224 are arranged radially. Further, although two magnets are shown in FIG. 2, in some embodiments, a single magnet is used as well as an array greater than two magnets.

Sensor assembly 226 includes an array of magnetic sensors 202A-202L, each configured to detect the magnetic field and changes to the magnetic field of magnetic material 224. Magnetic sensors 202A-202L in the sensor assembly 226 are directional magnetic sensors and will detect the magnetic field in the axial direction. For example, in the embodiment of FIG. 2, a value of 0 is detected by magnetic sensor 202C while magnetic material 224 is positioned at the position illustrated in FIG. 2. Further, values of V4, V3, V1, and V2 are detected by magnetic sensors 202A, 202B, 202D, and 202E, respectively, where each value corresponds to the value of the magnetic field of magnetic material 224 determined by the corresponding magnetic sensor. Processor 240 of downhole valve position sensing system 223 obtains values 0 and V1-V4, and utilizes the values to determine the corresponding location of magnetic material 224. Further, processor 240 utilizes the location of magnetic material 224 with respect to actuation member 228 to determine the position of actuation member 228, and, in turn, utilizes the position of actuation member 228 to determine the position of downhole valve 222. In some embodiments, processor 240 is configured to perform the foregoing operations to determine the position of downhole valve 222 with only one value from a single magnetic sensor. In some embodiments, processor 240 cross-correlates multiple values obtained from multiple magnetic sensors to pinpoint the location of magnetic material 224.

In the embodiment of FIG. 2, one magnetic material 224 is used to determine the position of downhole valve 222. In some embodiments, multiple magnetic materials are utilized to determine the position of downhole valve 222. Further, in the embodiment of FIG. 2 magnetic sensors 202A-202L are non-uniformly positioned across downhole valve 222. In one or more of such embodiments, additional magnetic sensors are positioned near locations that correspond to locations that align with a location of magnetic material 224 when downhole valve 222 is opened or closed. In some embodiments, magnetic sensors 202A-202L are uniformly positioned across downhole valve 222. Further, although magnetic sensors 202A-202L of FIG. 2 are aligned in an axial direction, in some embodiments, sensor assembly 226 includes additional magnetic sensors that are positioned in a radial direction, a circumferential direction, or another direction to detect movement of magnetic material 224 in non-axial directions. Further, although processor 240 and sensor assembly 226 of FIG. 2 are housed in the same housing, in some embodiments, processor 240 is a component of another downhole device, or a surface-based device. In the embodiment of FIG. 2, magnetic sensors 202A-202L are non-contacting sensors such that such that there is no mechanical or physical linkage with downhole valve 222. In some embodiments, a pressure barrier separates magnetic sensors 202A-202L and downhole valve 222. In some embodiments, some of the magnetic sensors are contacting sensors, where there is a linkage with downhole valve 222.

Figure 3A:
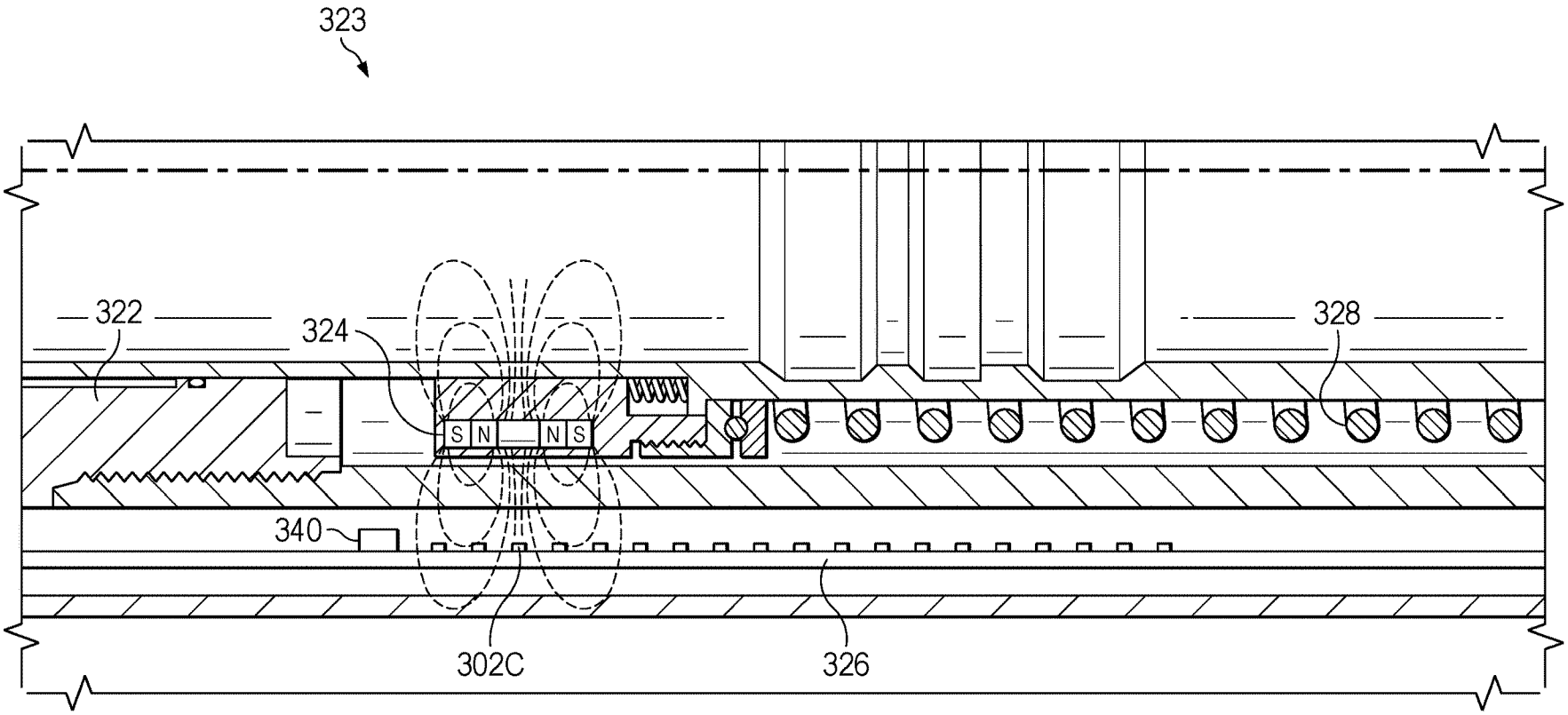
FIG. 3A is a schematic, cross-sectional view of a downhole valve position sensing system similar to the downhole valve position sensing system of FIG. 2 while the magnetic material is positioned at a first position along a downhole valve.
Figure 3B:
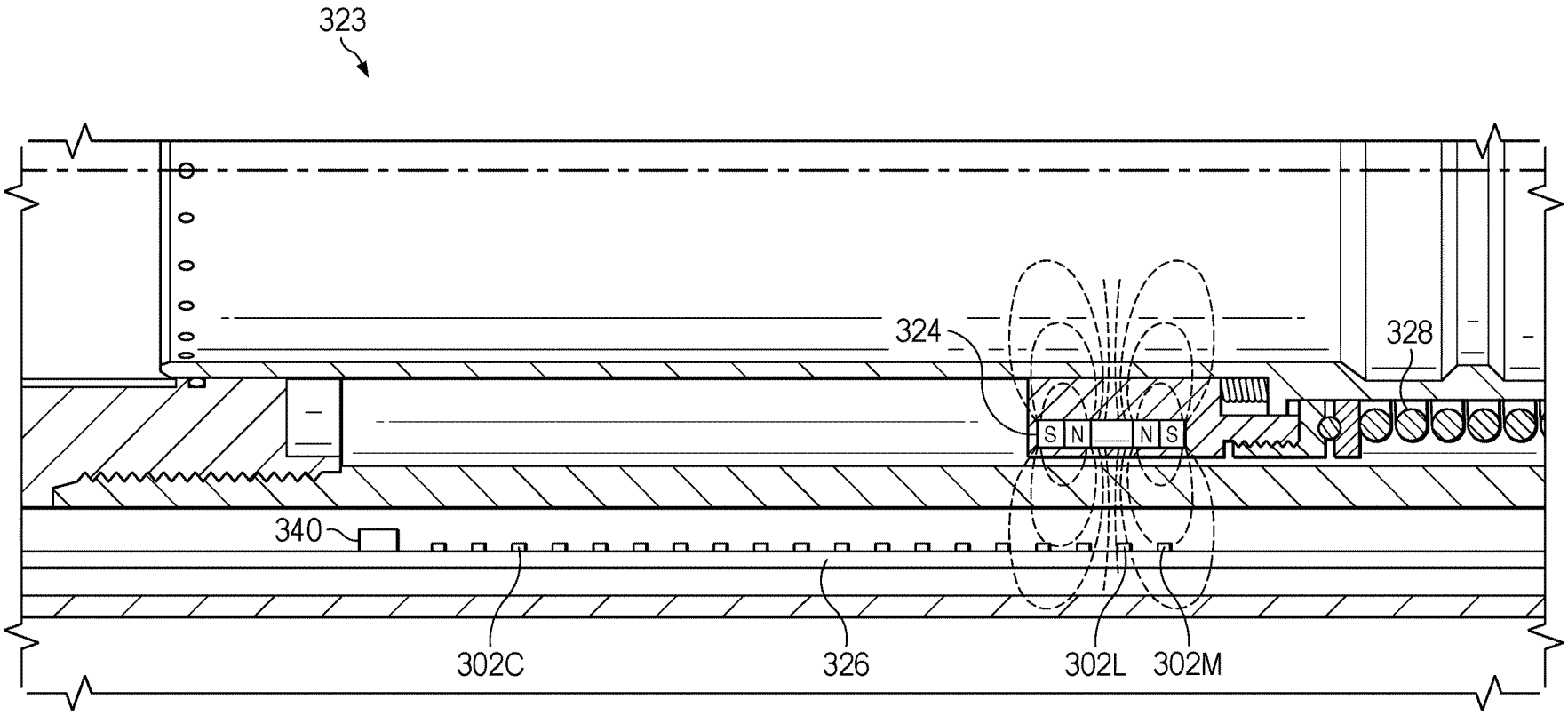
FIG. 3B is a schematic, cross-sectional view of the downhole valve position sensing system of FIG. 3A after the magnetic material is shifted to a second position along a downhole valve.

FIG. 3A is a schematic, cross-sectional view of a downhole valve position sensing system 323 similar to downhole valve position sensing system 223 of FIG. 2 while a magnetic material 324 is positioned at a first position along a downhole valve 322. Further, FIG. 3B is a schematic, cross-sectional view of downhole valve position sensing system 323 of FIG. 3A after magnetic material 324 is shifted to a second position along downhole valve 322. In the embodiment of FIGS. 3A and 3B, downhole valve position sensing system 323 includes a magnetic material 324 that emits a magnetic field, a processor 340, and a sensor assembly 326 that is coupled to or positioned near an exterior surface of downhole valve 322, and configured to detect the magnetic field and change to the magnetic field of magnetic material 324.

Moreover, in the embodiment of FIGS. 3A and 3B, magnetic material 324 is coupled to a actuation member 328 (spring) that is configured to shift from a first position illustrated in FIG. 3A to a second position illustrated in FIG. 3B. In the embodiment of FIG. 3A, while magnetic material 324 is at the position illustrated in FIG. 3A, the magnetic field emitted by magnetic material 324 is detected by magnetic sensor 302C of sensor assembly 326. Moreover, in the embodiment of FIG. 3B, while magnetic material 324 is at the position illustrated in FIG. 3B, the magnetic field emitted by magnetic material 324 is detected by magnetic sensors 302L and 302M of sensor assembly 326. Processor 340 of downhole valve position sensing system 323 obtains the values obtained by magnetic sensors 302C, 302L and 302M, and utilizes the values to determine the corresponding location of magnetic material 324. Further, processor 340 utilizes the location of magnetic material 324 with respect to actuation member 328 to determine the position of actuation member 328, and, in turn, utilizes the position of actuation member 328 to determine the position of downhole valve 322. In some embodiments, processor 340 is configured to perform the foregoing operations to determine the position of downhole valve 322 with only one value from a single magnetic sensor. In some embodiments, processor 340 cross-correlates multiple values obtained from multiple magnetic sensors to pinpoint the location of magnetic material 324.

In the embodiment of FIGS. 3A and 3B, one magnetic material 324 is used to determine the position of downhole valve 322. In some embodiments, a different number of magnetic materials are utilized to determine the position of downhole valve 322. Further, in the embodiment of FIGS. 3A and 3B, the magnetic sensors are uniformly positioned across downhole valve 322. In some embodiments, the magnetic sensors are non-uniformly positioned across downhole valve 322. Further, although the magnetic sensors of FIGS. 3A and 3B are aligned in an axial direction, in some embodiments, sensor assembly 326 includes additional magnetic sensors that are positioned in a radial direction, a circumferential direction, or another direction to detect movement of magnetic material 324 in non-axial directions. Further, although processor 340 and sensor assembly 326 of FIGS. 3A and 3B are housed in the same housing, in some embodiments, processor 340 is a component of another downhole device, or a surface-based device.

Figure 4:
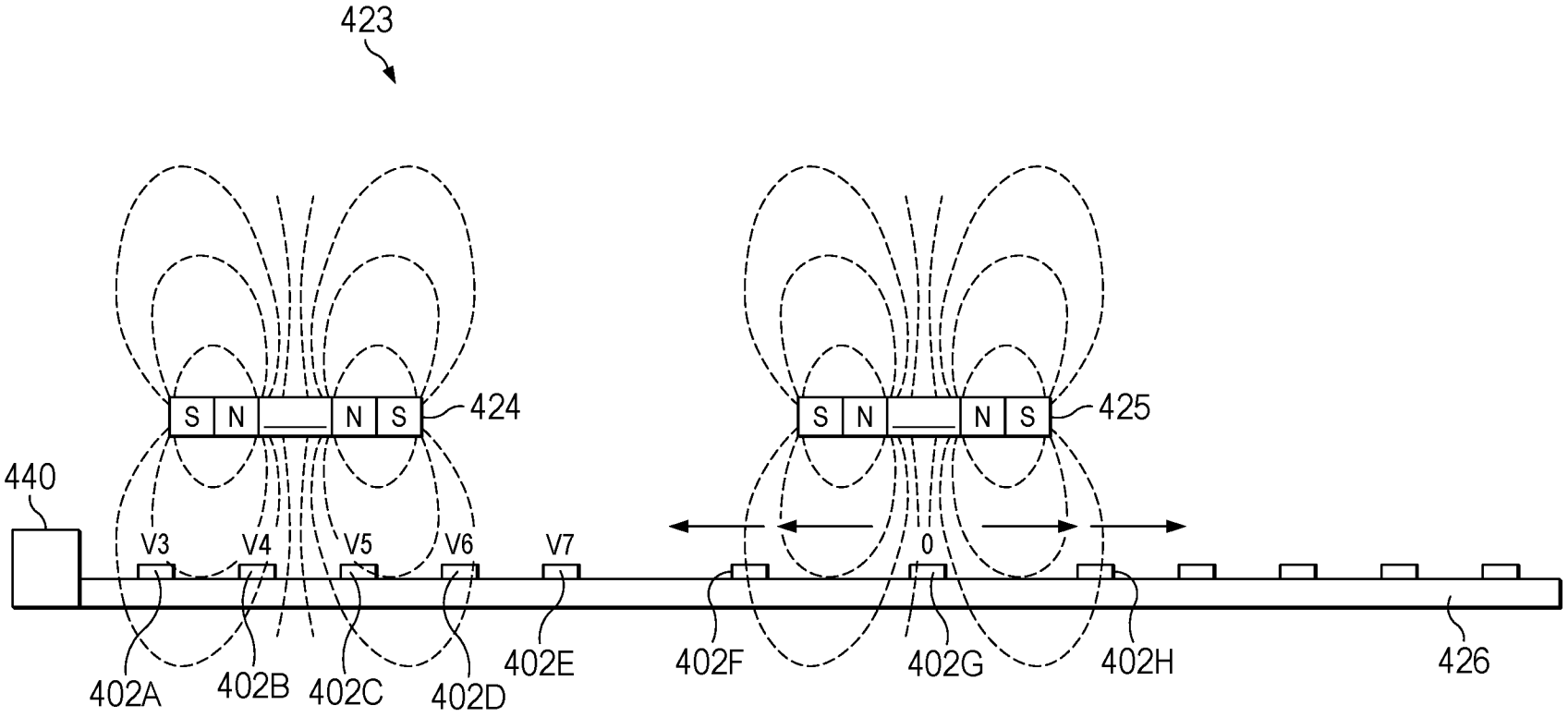
FIG. 4 is a schematic, cross-sectional view of a downhole valve position sensing system similar to the downhole valve position sensing system of FIG. 2, and having two magnetic materials positioned at different positions along a downhole valve.

FIG. 4 is a schematic, cross-sectional view of a downhole valve position sensing system 423 similar to downhole valve position sensing system 223 of FIG. 2, and having two magnetic materials 424 and 425 positioned at different positions along a downhole valve (not shown). In the embodiment of FIG. 4, downhole valve position sensing system 423 includes two magnetic materials 424 and 425 positioned at two different locations, and each emitting a magnetic field. Downhole valve position sensing system 423 also includes a processor 440, and a sensor assembly 426 that is coupled to or positioned near an exterior surface of the downhole valve and configured to detect the magnetic fields and changes to the magnetic fields of magnetic materials 424 and 425.

Sensor assembly 426 includes an array of magnetic sensors, including magnetic sensors 402A-402H, each configured to detect the magnetic fields and changes to the magnetic fields of magnetic materials 424 and 425. For example, in the embodiment of FIG. 4, a value of 0 is detected by magnetic sensor 402G while magnetic material 425 is positioned at the position illustrated in FIG. 4. Further, values of V1 and V2 are detected by magnetic sensors 402F and 402H, respectively, where each value corresponds to the value of the magnetic field of magnetic material 425 determined by the corresponding magnetic sensor. Similarly, values of V3, V4, V5, V6, and V7 are detected by magnetic sensors 402A, 402B, 402C, 402D, and 402E, respectively, where each value corresponds to the value of the magnetic field of magnetic material 424 determined by the corresponding magnetic sensor. Processor 440 of downhole valve position sensing system 423 obtains values 0 and V1-V7, and utilizes the values to determine the corresponding locations of magnetic materials 424 and 425. Further, processor 440 utilizes the locations of magnetic materials 424 and 425 with respect to an actuation member (not shown) to determine the position of the actuation member, and, in turn, utilizes the position of the actuation member to determine the position of the downhole valve. In some embodiments, processor 440 is configured to perform the foregoing operations to determine the position of the downhole valve with only one value from a single magnetic sensor. In some embodiments, processor 440 cross-correlates multiple values obtained from multiple magnetic sensors to pinpoint the locations of magnetic materials 424 and 425.

In the embodiment of FIG. 4, two magnetic materials 424 and 425 are utilized to determine the position of the downhole valve. In some embodiments, a different number of magnetic materials (not shown) are utilized to determine the position of the downhole valve. Further, in the embodiment of FIG. 4 magnetic sensors 402A-402H are non-uniformly positioned across the downhole valve. In some embodiments, magnetic sensors 402A-402H are uniformly positioned across the downhole valve. Further, although magnetic sensors 402A-402H of FIG. 4 are aligned in an axial direction, in some embodiments, sensor assembly 426 includes additional magnetic sensors that are positioned in a radial direction, a circumferential direction, or another direction to detect movement of magnetic materials 424 and 425 in non-axial directions.

Figure 5:
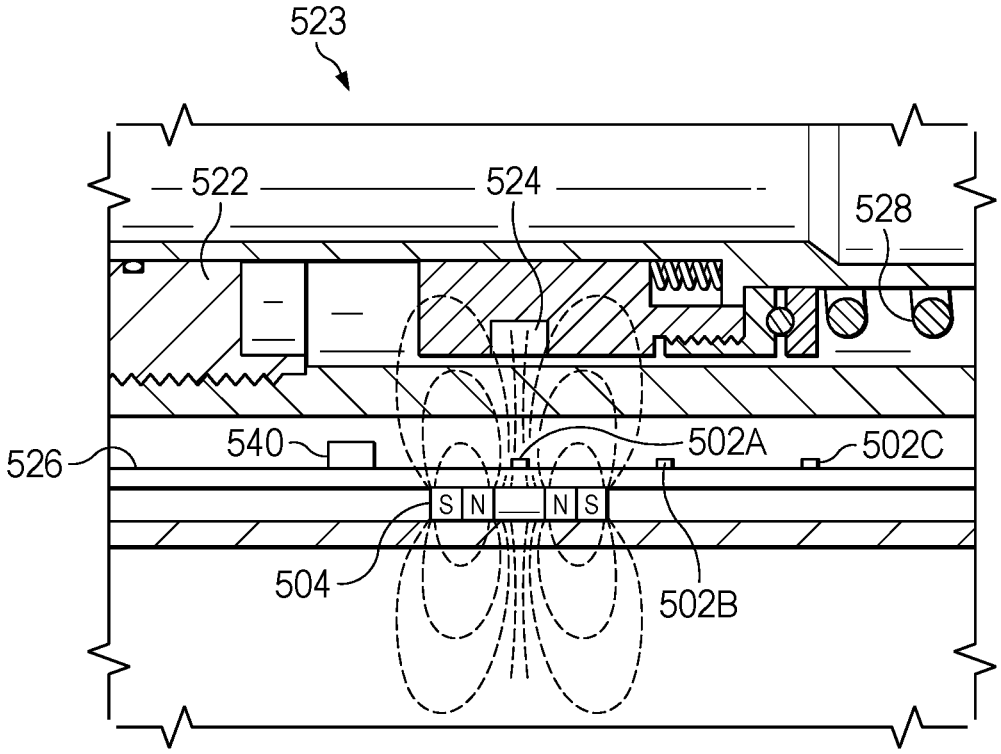
FIG. 5 is a schematic, cross-sectional view of a downhole valve position sensing system similar to the downhole valve position sensing system of FIG. 2, and having a magnetic material and a sensor assembly that are stored in the same housing.

FIG. 5 is a schematic, cross-sectional view of a downhole valve position sensing system 523 similar to downhole valve position sensing system 223 of FIG. 2, and having a magnet (magnetic material) 504 and a sensor assembly 526 that are stored in the same housing. In the embodiment of FIG. 5, downhole valve position sensing system 523 has another magnetic material (e.g., a ferromagnetic material) that is indirectly coupled to an actuation member 528 of a downhole valve 522. Downhole valve position sensing system 523 also includes a processor 540, and a sensor assembly 526 that is coupled to or positioned near an exterior surface of downhole valve 522, and configured to detect a distortion to a magnetic field emitted by magnet 504 as magnetic material 524 is shifted from the position illustrated in FIG. 5 to another position (not shown).

Sensor assembly 526 includes an array of magnetic sensors 502A-502C, each configured to the magnetic field and a distortion to the magnetic field of magnet 504. Processor 540 of downhole valve position sensing system 523 obtains the values associated with the magnetic field or distortions to the magnetic field, and utilizes the values to determine the corresponding location of magnetic material 524. Further, processor 540 utilizes the location of magnetic material 524 with respect to actuation member 528 to determine the position of actuation member 528, and, in turn, utilizes the position of actuation member 528 to determine the position of downhole valve 522. In some embodiments, processor 540 is configured to perform the foregoing operations to determine the position of downhole valve 522 with only one value from a single magnetic sensor.

In the embodiment of FIG. 5, one magnetic material 524 is used to determine the position of downhole valve 522. In some embodiments, multiple magnetic materials are utilized (similar to the embodiment illustrated in FIG. 4) to determine the position of downhole valve 522. Further, although magnetic sensors 502A-502C of FIG. 5 are aligned in an axial direction, in some embodiments, sensor assembly 526 includes additional magnetic sensors that are positioned in a radial direction, a circumferential direction, or another direction to detect movement of magnetic material 524 in non-axial directions.

Figure 6:
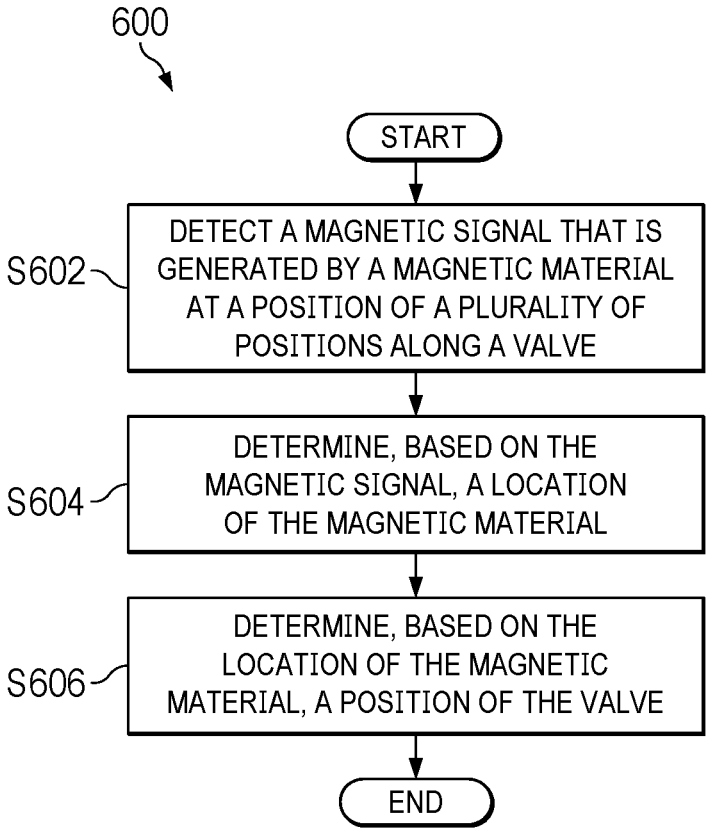
FIG. 6 illustrates a process to determine a position of a downhole valve.

FIG. 6 illustrates a process 600 to determine a position of a downhole valve. Although the operations in the process 600 are shown in a particular sequence, certain operations may be performed in different sequences or at the same time where feasible.

At block S602, a magnetic signal that is generated by a magnetic material at a position of a plurality of positions along a downhole valve is detected. In that regard, FIG. 2, for example, illustrates magnetic signals emitted by magnetic material 224 being detected by magnetic sensor 202C. In some embodiments, a distortion to a magnetic field generated by a magnetic material is detected. For example, in the embodiment of FIG. 5, magnetic sensors 502A-502C detect distortions to the magnetic field emitted by magnetic material (magnet) 504 due to shifting of magnetic material 524. In some embodiments, magnetic signals from multiple magnetic materials are detected. In that regard, FIG. 4, for example, illustrates magnetic signals emitted by magnetic materials 424 and 425 being detected by magnetic sensors 402A-402H.

At block S604, a location of the magnetic material is determined based on the magnetic signal. In that regard, processor 240 of FIG. 2 is configured to obtain values associated with the magnetic signals detected by magnetic sensors 202A-202L, and determine, based on the values, the location of the magnetic material. In some embodiments, where multiple magnetic materials are deployed along the valve, the location of each magnetic material is determined based on a corresponding signal of the respective magnetic material. For example, processor 440 of FIG. 4 is configured to determine the locations of magnetic materials 424 and 425 based on magnetic signals emitted by magnetic materials 424 and 425 and detected by magnetic sensors 402A-402H. In some embodiments, processor 240 correlates values obtained from multiple magnetic sensors to pinpoint the location of the magnetic material.

At block S606, the position of a downhole valve is determined based on the location of the magnetic material. For example, in the embodiment of FIG. 2, processor 240 utilizes the location of magnetic material 224 with respect to actuation member 228 to determine the position of actuation member 228. Processor 240 then utilizes the position of actuation member 228 to determine the position of downhole valve 222. In some embodiments, determining the position of the downhole valve includes determining the state of the downhole valve, including whether the downhole valve is fully open, partially open (e.g., 10% open, 20% open, 50% open, etc.), or fully closed. In some embodiments, determining the position of the downhole valve includes determining the distance or amount of movement an actuation member should move in one or more directions to open or close the downhole valve. In some embodiments, where multiple magnetic materials are deployed along the downhole valve, the position of the downhole valve is determined based on the locations of the magnetic materials. In one or more of such embodiments, the locations of the magnetic materials are correlated with each other to pinpoint the position of the downhole valve.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification.

Clause 1, a downhole valve position sensing system, comprising: a magnetic material that is shiftable by an actuation member of a downhole valve to a plurality of positions along a downhole valve from a first position of the plurality of positions along the downhole valve; and a sensor assembly that is mechanically coupled to the downhole valve and comprising a magnetic sensor that is configured to detect a magnetic signal generated by the magnetic material at a set of positions of the plurality of positions along the downhole valve.

Clause 2, the downhole valve position sensing system of clause 1, wherein the sensor assembly comprises an array of magnetic sensors, wherein each magnetic sensor of the array of magnetic sensors is configured to detect a corresponding magnetic signal generated by the magnetic material at the set of positions, and wherein the magnetic sensor is one magnetic sensor of the array of magnetic sensors.

Clause 3, the downhole valve position sensing system of clause 2, wherein a first set of sensors of the array of sensors are configured to detect the magnetic signal generated by the magnetic material while the magnetic material shifts in an axial direction, a second set of sensors of the array of sensors are configured to detect the magnetic signal generated by the magnetic material while the magnetic material shifts in a radial direction, and a third set of sensors of the array of sensors are configured to detect the magnetic signal generated by the magnetic material while the magnetic material shifts in a circumferential direction.

Clause 4, the downhole valve position sensing system of clauses 2 or 3, wherein one or more sensors of the array of sensors are uniformly distributed along the sensor assembly.

Clause 5, the downhole valve position sensing system of clauses 2 or 3, wherein one or more sensors of the array of sensors are not uniformly distributed along the sensor assembly.

Clause 6, the downhole valve position sensing system of any of clauses 2-5, wherein the magnetic signal is a magnetic field, a magnetic flux, or a magnetic flux density.

Clause 7, the downhole valve position sensing system of any of clauses 1-6, further comprising a second magnetic material that is shiftable along a second plurality of positions along the downhole valve, wherein the magnetic sensor is configured to detect a second magnetic signal generated by the second magnetic material at a second set of positions of the second plurality of positions.

Clause 8, the downhole valve position sensing system of clause 7, wherein the plurality of positions and the second plurality of positions are positions along different axial, circumferential, or radial directions.

Clause 9, the downhole valve position sensing system of clauses 7 or 8, further comprising a processor configured to: determine, based on the magnetic signal, a location of the magnetic material; determine, based on the second magnetic signal, a second location of the second magnetic material; and determine, based on the location of the magnetic material and the second location of the second magnetic material, a position of the downhole valve.

Clause 10, the downhole valve position sensing system of any of clauses 1-9, further comprising a magnet that is positioned in a housing of the sensor assembly, wherein the magnetic sensor is further configured to detect a distortion to a magnetic signal generated by the magnet at the set of positions.

Clause 11, the downhole valve position sensing system of any of clauses 1-10, further comprising a processor configured to: determine, based on the magnetic signal, a location of the magnetic material; and determine, based on the location of the magnetic material, a position of the downhole valve.

Clause 12, the downhole valve position sensing system of any of clauses 1-11, wherein the magnetic material is a magnet.

Clause 13, the downhole valve position sensing system of any of clauses 1-12, wherein the magnetic material is a magnetic metal.

Clause 14, a downhole valve, comprising: an actuation member configured to shift from a first actuation member position to a second actuation member position; a magnetic material that is shiftable by the actuation member to a plurality of positions along a downhole valve as the actuation member shifts from the first actuation member position to the second actuation member position; and a sensor assembly that is mechanically coupled to the downhole valve and comprising a magnetic sensor that is configured to detect a magnetic signal generated by the magnetic material at a set of positions of the plurality of positions along the downhole valve.

Clause 15, the downhole valve of clause 14, wherein the sensor assembly comprises an array of magnetic sensors, wherein each magnetic sensor of the array of magnetic sensors is configured to detect a corresponding magnetic signal generated by the magnetic material at the set of positions, and wherein the magnetic sensor is one magnetic sensor of the array of magnetic sensors.

Clause 16, the downhole valve of clauses 14 or 15, wherein the actuation member is a sleeve, a piston, a spring, or a cover of the downhole valve.

Clause 17, the downhole valve of any of clauses 14-16, wherein the downhole valve is one of a subsurface safety valve, a tubing retrievable subsurface safety valve, and a fluid loss valve.

Clause 18, a method to determine a position of a downhole valve, comprising: detecting a magnetic signal that is generated by a magnetic material at a position of a plurality of positions along a downhole valve, wherein the magnetic material is shiftable by an actuation member of the downhole valve to the plurality of positions along the downhole valve; determining, based on the magnetic signal, a location of the magnetic material; and determining, based on the location of the magnetic material, a position of the downhole valve.

Clause 19, the method of clause 18, further comprising: detecting a second magnetic signal that is generated by a second magnetic material at a second position of the plurality of positions along a downhole valve; determining, based on the second magnetic signal, a second location of the second magnetic material; and determining, based on the location of the magnetic material and the second location of the second magnetic material, the position of the downhole valve.

Clause 20, the method of clauses 18 or 19, wherein determining the position of the downhole valve comprises determining, based on the location of the magnetic material, whether the downhole valve is in an open position or a closed position.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A downhole valve position sensing system, comprising:

a magnetic material that is shiftable by an actuation member of a downhole valve to a plurality of positions comprising axially positions and circumferential positions along a downhole valve from a first position of the plurality of positions along the downhole valve; wherein the axial positions are arranged in the direction of the longitudinal axis of the downhole valve and the circumferential positions are arranged circumferentially around the longitudinal axis of the downhole valve; wherein the magnetic material is configured to be shifted along the axial and circumferential positions and between the axial and circumferential positions; and a sensor assembly that is mechanically coupled to the downhole valve and comprising a magnetic sensor that is configured to detect a magnetic signal generated by the magnetic material at a set of positions of the plurality of positions along the downhole valve, wherein the sensor assembly and the magnetic material are positioned on opposite sides of a housing.

2. The downhole valve position sensing system of claim 1, wherein the sensor assembly comprises an array of magnetic sensors, wherein each magnetic sensor of the array of magnetic sensors is configured to detect a corresponding magnetic signal generated by the magnetic material at the set of positions, and wherein the magnetic sensor is one magnetic sensor of the array of magnetic sensors.

3. The downhole valve position sensing system of claim 2, wherein a first set of sensors of the array of sensors are configured to detect the magnetic signal generated by the magnetic material while the magnetic material shifts in an axial direction with respect to a longitudinal axis of the downhole valve, a second set of sensors of the array of sensors are configured to detect the magnetic signal generated by the magnetic material while the magnetic material shifts in a radial direction with respect to the longitudinal axis of the downhole valve, and a third set of sensors of the array of sensors are configured to detect the magnetic signal generated by the magnetic material while the magnetic material shifts in a circumferential direction with respect to the longitudinal axis of the downhole valve.

4. The downhole valve position sensing system of claim 2, wherein one or more sensors of the array of sensors are uniformly distributed along the sensor assembly.

5. The downhole valve position sensing system of claim 2, wherein one or more sensors of the array of sensors are not uniformly distributed along the sensor assembly.

6. The downhole valve position sensing system of claim 2, wherein the magnetic signal is a magnetic field, a magnetic flux, or a magnetic flux density.

7. The downhole valve position sensing system of claim 1, further comprising a second magnetic material that is shiftable along a second plurality of positions along the downhole valve, wherein the magnetic sensor is configured to detect a second magnetic signal generated by the second magnetic material at a second set of positions of the second plurality of positions.

8. The downhole valve position sensing system of claim 7, wherein the plurality of positions and the second plurality of positions are positions along different axial, circumferential, or radial directions.

9. The downhole valve position sensing system of claim 7, further comprising a processor configured to:

determine, based on the magnetic signal, a location of the magnetic material;

determine, based on the second magnetic signal, a second location of the second magnetic material; and determine, based on the location of the magnetic material and the second location of the second magnetic material, a position of the downhole valve.

10. The downhole valve position sensing system of claim 1, further comprising a magnet that is positioned in a housing of the sensor assembly, wherein the magnetic sensor is further configured to detect a distortion to a magnetic signal generated by the magnet at the set of positions.

11. The downhole valve position sensing system of claim 1, further comprising a processor configured to:

determine, based on the magnetic signal, a location of the magnetic material; and determine, based on the location of the magnetic material, a position of the downhole valve.

12. The downhole valve position sensing system of claim 1, wherein the magnetic material is a magnet.

13. The downhole valve position sensing system of claim 1, wherein the magnetic material is a magnetic metal.

14. A downhole valve, comprising:

an actuation member configured to shift from a first actuation member position to a second actuation member position;

a magnetic material that is shiftable by the actuation member to a plurality of positions comprising axially positions and circumferential positions along a downhole valve as the actuation member shifts from the first actuation member position to the second actuation member position; wherein the axial positions are arranged in the direction of the longitudinal axis of the downhole valve and the circumferential positions are arranged circumferentially around the longitudinal axis of the downhole valve; wherein the magnetic material is configured to be shifted along the axial and circumferential positions and between the axial and circumferential positions; and a sensor assembly that is mechanically coupled to the downhole valve and comprising a magnetic sensor that is configured to detect a magnetic signal generated by the magnetic material at a set of positions of the plurality of positions along the downhole valve, wherein the sensor assembly and the magnetic material are positioned on opposite sides of a housing.

15. The downhole valve of claim 14, wherein the sensor assembly comprises an array of magnetic sensors, wherein each magnetic sensor of the array of magnetic sensors is configured to detect a corresponding magnetic signal generated by the magnetic material at the set of positions, and wherein the magnetic sensor is one magnetic sensor of the array of magnetic sensors.

16. The downhole valve of claim 14, wherein the actuation member is a sleeve, a piston, a spring, or a cover of the downhole valve.

17. The downhole valve of claim 14, wherein the downhole valve is one of a subsurface safety valve, a tubing retrievable subsurface safety valve, and a fluid loss valve.

18. A method to determine a position of a downhole valve, comprising:

detecting a magnetic signal that is generated by a magnetic material at a position of a plurality of positions along a downhole valve, wherein the magnetic material is shiftable by an actuation member of the downhole valve to the plurality of positions comprising axially positions and circumferential positions along the downhole valve; wherein the axial positions are arranged in the direction of the longitudinal axis of the downhole valve and the circumferential positions are arranged circumferentially around the longitudinal axis of the downhole valve; wherein the magnetic material is configured to be shifted along the axial and circumferential positions and between the axial and circumferential positions;

determining, based on the magnetic signal, a location of the magnetic material; and determining, based on the location of the magnetic material, a position of the downhole valve, wherein the magnetic signal is detected by a sensor of a sensor assembly, and wherein the sensor assembly and the magnetic material are positioned on opposite sides of a housing.

19. The method of claim 18, further comprising:

detecting a second magnetic signal that is generated by a second magnetic material at a second position of the plurality of positions along a downhole valve;

determining, based on the second magnetic signal, a second location of the second magnetic material; and determining, based on the location of the magnetic material and the second location of the second magnetic material, the position of the downhole valve.

20. The method of claim 18, wherein determining the position of the downhole valve comprises determining, based on the location of the magnetic material, whether the downhole valve is in an open position or a closed position.

* * * * *